US007431444B2

(12) United States Patent
Ito

(10) Patent No.: US 7,431,444 B2
(45) Date of Patent: Oct. 7, 2008

(54) INKJET HEAD WITH FILTER FOR INK SUPPLY OPENINGS

(75) Inventor: Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 282 days.

(21) Appl. No.: 11/064,681

(22) Filed: Feb. 23, 2005

(65) Prior Publication Data

US 2005/0225608 A1 Oct. 13, 2005

(30) Foreign Application Priority Data

Feb. 23, 2004 (JP) ..... 2004-046637

(51) Int. Cl.
*B41J 2/175* (2006.01)
*B41J 2/045* (2006.01)

(52) U.S. Cl. ..... 347/93; 347/71

(58) Field of Classification Search ..... 347/68, 347/93

See application file for complete search history.

(56) References Cited

U.S. PATENT DOCUMENTS 5,402,159 A 3/1995 Takahashi et al.
5,489,930 A * 2/1996 Anderson ..... 347/71
6,139,674 A * 10/2000 Markham et al. ..... 347/93
6,554,409 B2 * 4/2003 Ishii ..... 347/71
6,827,423 B1 * 12/2004 Katakura et al. ..... 347/40
6,830,325 B2 * 12/2004 Hirota et al. ..... 347/94
6,994,428 B2 * 2/2006 Ito ..... 347/68
7,261,862 B2 * 8/2007 Noritake et al. ..... 347/68
2004/0179057 A1 * 9/2004 Yamada ..... 347/20
2005/0162484 A1 * 7/2005 Isono ..... 347/68

FOREIGN PATENT DOCUMENTS

JP 4-341853 11/1992
JP 2002-036545 2/2002
JP 2004268454 A * 9/2004

* cited by examiner

*Primary Examiner*—Matthew Luu
*Assistant Examiner*—Shelby Fidler
(74) *Attorney, Agent, or Firm*—Reed Smith LLP

(57) ABSTRACT

There is provided an inkjet head with a plurality of nozzle rows, each of which has a plurality of nozzles arranged along a first direction. A plurality of fluid channels connects a plurality of common ink chambers to the plurality nozzles via the plurality of pressure chambers, and a plurality of ink supply openings corresponds to the plurality of common ink chambers. Each of the plurality of ink supply openings communicates with a corresponding one of the plurality of common ink chambers. The inkjet head also includes a filter that covers the plurality of ink supply openings. The filter includes filtering portions that eliminate dust in ink flowing therethrough. Each filtering portion respectively corresponds to one of the plurality of ink supply openings, and is configured such that each filtering portion's dimension in the first direction is longer than its dimension in the second direction when viewed in plan view.

9 Claims, 6 Drawing Sheets

INKJET HEAD WITH FILTER FOR INK SUPPLY OPENINGS

INCORPORATION BY REFERENCE

This application claims priority of Japanese Patent Application No. 2004-046637, filed on Feb. 23, 2004, the entire subject matter of the application is incorporated herein by reference thereto.

BACKGROUND OF THE INVENTION

The present invention relates to a piezoelectric type inkjet head used for an inkjet printing device.

Inkjet printers employing a piezoelectric type inkjet head for ejecting ink onto a substrate are widely used. Japanese Patent Provisional Publication No. 2002-36545 discloses one of such inkjet printers. An inkjet head disclosed in the publication has a cavity unit including a plurality of plates laminated with each other by use of an adhesive, a piezoelectric actuator adhered to a rear surface of the cavity unit, and a flexible flat cable adhered to a rear surface of the piezoelectric actuator which is electrically connected to an external device.

More specifically, the cavity unit includes a nozzle plate, a manifold plate and a base plate each of which has a rectangular shape when viewed as a plan view. The nozzle plate situated on a front side of the cavity unit is provided with a plurality of nozzles which are arranged in two rows along a longer side direction of the nozzle plate. The base plate situated on a rear side of the cavity unit is provided with a plurality of pressure chambers which are aligned in two rows along an arranging direction of the plurality of nozzles. The manifold plate situated between the nozzle plate and the base plate is provided with two common ink chambers elongated along an arranging direction of the pressure chambers.

At one end portion of the base plate, two ink supply openings are opened to be aligned in parallel with a shorter side of the base plate so that the ink supply openings communicate with the corresponding common ink chambers.

In the above mentioned configuration of the inkjet head, the number of nozzle rows, the number of pressure chamber rows, the number of common ink chambers, and the number of ink supply openings are equal to each other.

It is also disclosed in the publication that the two ink supply openings are covered with a filter.

SUMMARY OF THE INVENTION

Recently, for enhancing printing speed and printing resolution, it is required to increase the number of nozzle rows of the cavity unit. If the number of nozzle rows is increased in the configuration of the cavity unit of the above mentioned publication, it is required to increase the number of common ink chambers and the number of ink supply openings in accordance with the number of nozzle rows.

For example, if a cavity unit used for color printing based on four color components of black, yellow, magenta and cyan is designed based on the configuration of the cavity unit disclosed in the above mentioned publication, four ink supply openings will be formed on one end portion of the base plate to be aligned along the shorter side of the base plate. If the cavity unit for color printing is designed in such a manner, two filters are required to cover four ink supply openings because the filter disclosed in the publication is configured to cover only two ink supply openings. In this case, two filters will be adhered to the base plate to be aligned in parallel with the shorter side of the base plate.

In this case, in view of a size of each filtering portion of the filter, the two filters are required to be adhered to the base plate so that peripheral portions thereof do not overlap with each other. Such a configuration further requires to increase the width between inner two ink supply openings. Consequently, the length of the shorter side of the base plate increases, and thereby the size of the base plate (i.e. the inkjet head) is increased.

Also, in this case, manufacturing processes are increased by the increase of the number of filters.

The present invention is advantageous in that it provides an inkjet head configured to be compact in size even if the number nozzle rows is increased.

According to an aspect of the invention, there is provided an inkjet head which is provided with a plurality of nozzle rows each of which has a plurality of nozzles arranged along a first direction, a plurality of pressure chambers connected to the plurality of nozzles, a plurality of common ink chambers respectively corresponding to the plurality of nozzle rows, a plurality of fluid channels connecting the plurality of common ink chambers to the plurality nozzles via the plurality of pressure chambers, and a plurality of ink supply openings corresponding to the plurality of common ink chambers. The plurality of ink supply openings is arranged along a second direction different from the first direction so that each of the plurality of ink supply openings communicates with corresponding one of the plurality of common ink chambers. The inkjet head is further provided with a filter located to cover the plurality of ink supply openings.

In this structure, the filter includes filtering portions that have functions of eliminating dust in ink flowing therethrough. The filtering portions respectively correspond to the plurality of ink supply openings. Each of the filtering portions is configured such that a size of an outline thereof in the first direction is longer than a size of the outline in the second direction when viewed as a plan view.

With this configuration, since the filter covers the plurality of ink supply openings, it is not necessary to increase the number of filters in accordance with the number of ink supply openings. Also, it becomes possible to reduce the width of each filtering portion in the second direction, and thereby it becomes possible to reduce the length of the filter in the second direction while securing an adequate size of each filtering portion in a plan view.

Further, the filter can be as compact as possible while attaining the adequate filtering function. Accordingly, the inkjet head can be configured to be compact in size.

In a particular case, the inkjet head may have a rectangular shape. In this case, the first direction is parallel with a longer side direction of the rectangular shape of the inkjet head, and the second direction is parallel with a shorter side direction of the rectangular shape of the inkjet head.

In a particular case, each of the filtering portions may have an elliptical shape.

Optionally, at least one ink supply opening of the plurality of ink supply openings may communicate with two or more of the plurality of common ink chambers, and one of the filtering portions corresponding to the at least one ink supply opening may have an outline shape larger than outline shapes of all of the other filtering portions.

Still optionally, each of the filtering portions may be elongated along a direction in which each of the common ink chambers is elongated. In this case, each of the plurality of ink supply openings has a shape substantially the same as that of corresponding one of the filtering portions. Each of the filtering portions communicates with an end portion of corresponding one of the plurality of common ink chambers via corresponding one of the plurality of ink supply openings.

Still optionally, each of the filtering portions may substantially overlap with the corresponding one of the plurality of ink supply openings and the end portion of the corresponding one of the plurality of common ink chambers when viewed as a plan view so that no step portion is formed in a fluid channel formed of the each of the filtering portions, the corresponding one of the plurality of ink supply openings and the end portion of the corresponding one of the plurality of common ink chambers.

In a particular case, the filter may be formed to be a thin sheet-type member.

In a particular case, the inkjet head may have a laminated structure of a plurality of layers, and the filter may have a gluing part surrounding the filtering portions, the filter being adhered to an end portion of a layer being is provided with the plurality of ink supply openings through the gluing part.

In a particular case, the plurality of common ink chambers may include five common ink chambers, the plurality of ink supply openings may include four ink supply openings, and the filtering portions may include four filtering portions.

BRIEF DESCRIPTION OF THE ACCOMPANYING DRAWINGS

DETAILED DESCRIPTION OF THE EMBODIMENTS

Hereafter, an embodiment according to the present invention will be described with reference to the accompanying drawings.

Figure 1:
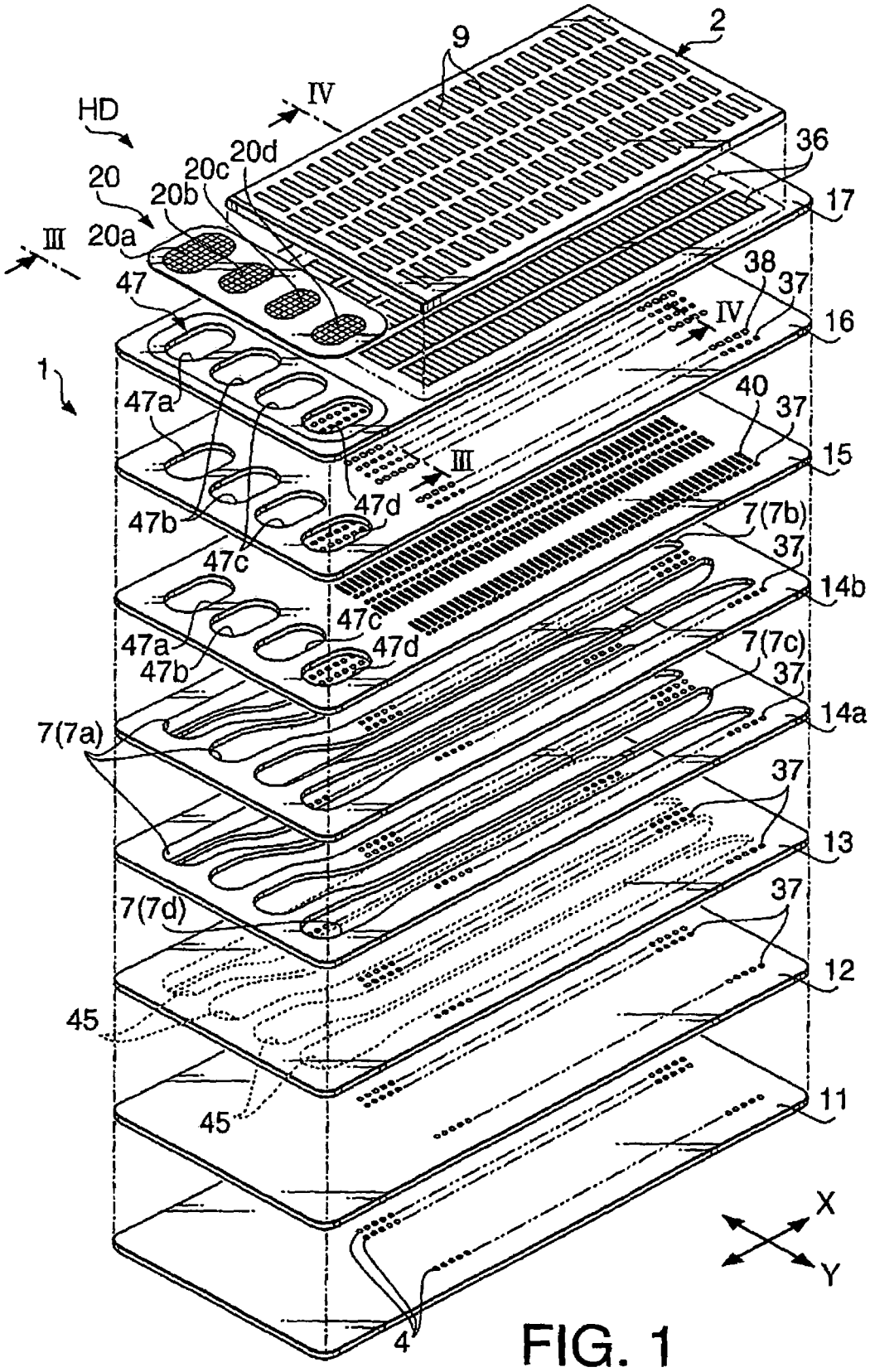
FIG. 1 is a partial exploded view of a piezoelectric type inkjet head according to the embodiment of the invention.

As shown in FIG. 1, the inkjet head HD includes a cavity unit 1 made from metal plates and a plate type piezoelectric actuator 2. In FIG. 1 the cavity unit 1 is illustrated as an exploded view. The piezoelectric actuator 2 is adhered to a top surface of the cavity unit 1, and a flexible flat cable 3 (see FIG. 3) is adhered to a top surface of the piezoelectric actuator 2 for electrical connection to an external device (e.g. an external controller). On the lowest layer (plate) of the cavity unit 1, a plurality of nozzles 4 are opened. By this structure, ink is ejected downwardly from the nozzles 4.

The configuration of the cavity unit 1 will be explained in detail with reference to FIGS. 1 to 3. The cavity unit 1 includes a nozzle plate 11, a first spacer plate 12, a damper plate 13, two manifold plates 14*a* and 14*b*, a second spacer plate 15, a third spacer plate 16, and a base plate 17 which are laminated with each other by adhesions. That is, the cavity unit 1 has eight plates in total.

In this embodiment, each of the plates 12, 13, 14*a*, 14*b*, 15, 16 and 17 is made of 42% nickel alloy steel sheet having a thickness of 50 through 160 μm. The plurality of nozzles 4 from which ink is ejected are formed in the nozzle plate 11 so as to be aligned in predetermined minute intervals which correspond to printing resolution. More specifically, five nozzle rows are formed in the nozzle plate 11. In each nozzle row, the nozzles 4 are aligned in a staggered arrangement in a longer side direction (X-direction) of the nozzle plate 11.

In the base plate 17, a plurality of pressure chambers 36 are formed in five rows along the X-direction. In each pressure chamber row, the pressure chambers 36 are aligned in a staggered arrangement. As shown in FIG. 2, in the base plate 17, each pressure chamber 36 is configured to be a slender opening elongated along a shorter side direction (Y-direction) of the base plate 17. One end portion 36*a* of the pressure chamber 36 communicates with the nozzle 4, and the other end portion 36*b* of the pressure chamber 36 communicates with a common ink chamber 7. In this embodiment, a longitudinal direction (a direction of a line connecting the end portions 36*a* and 36*b*) of the pressure chamber 36 equals to the Y-direction.

Figure 2:
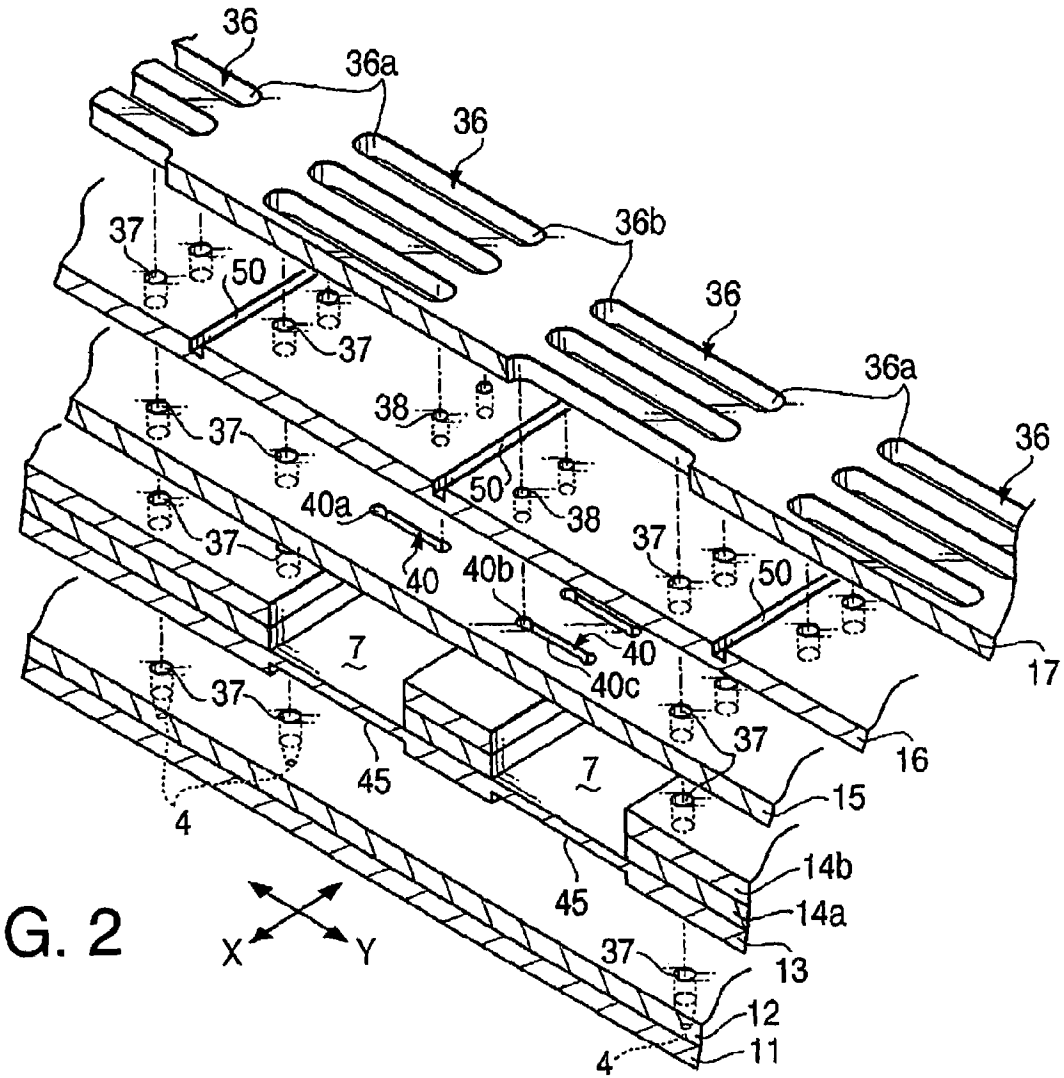
FIG. 2 is an enlarged exploded view of a part of the inkjet head.

As shown in FIG. 2, the end portion 36*a* of the pressure chamber 36 communicates with the nozzle 4 via through holes 37 which are respectively formed in the second and third spacer plates 15 and 16, the manifold plates 14*a* and 14*b*, the damper plate 13 and the first spacer plate 12. The through holes 37, each of which has a minute diameter, are also aligned in a staggered arrangement on each of the plates 12, 13, 14*a*, 14*b*, 15 and 16 in accordance with the arrangement of the nozzles 4.

In the third spacer plate 16 adhered to the bottom surface of the base plate 17, through holes 38 are formed at positions corresponding to the end portions 36*b* of the pressure chambers 36 so that the end portions 36*b* communicate with the through holes 38, respectively.

In the second spacer plate 15 adhered to the bottom surface of the third spacer plate 16, channels 40 are formed for the ink supply from the common ink chambers 7 to the respective pressure chambers 36. The channel 40 has an inlet hole 40*a* to which ink enters from the common ink chamber 7, an outlet hole 40*b* from which ink exits toward the pressure chamber 36 (the through hole 38), and a narrow space portion 40*c* formed to connect the inlet hole 40*a* and the outlet hole 40*b*. The narrow space portion 40*c* is formed to have a cross-sectional area smaller than that of the outlet hole 40*b* so that the narrow space portion 40*c* has the maximum fluid channel drag in the channel 40.

The narrow space portion 40*c* is formed by conducting half-etching on the top surface (adjoining to the third spacer plate 16) of the second spacer plate 15 so that the narrow space portion 40*c* has predetermined fluid channel drag. The inlet hole 40*a* and outlet hole 40*b* are aligned with end portions of the narrow space portion 40*c*, respectively. The inlet hole 40*a* is formed as a through hole penetrating the second spacer plate 15. The outlet hole 40*b* is formed on the top surface of the second spacer plate 15 as a recessed portion.

In this embodiment, five common ink chambers 7 are formed to penetrate the manifold plates 14*a* and 14*b* so that each of the common ink chambers 7 is elongated along the arranging direction (X-direction) of the nozzle row. By laminating the manifold plates 14*a* and 14*b*, adhering the second spacer plate 15 to the top surface of the manifold plate 14*b*, and then adhering the damper plate 13 to the bottom surface of the manifold plate 14*a*, the five common ink chambers 7 are hermetically sealed. Each common ink chamber 7 is elongated along the arranging direction of the pressure chamber row when viewed along the laminating direction of the cavity unit 1 (see FIGS. 5 and 6).

Figure 3:
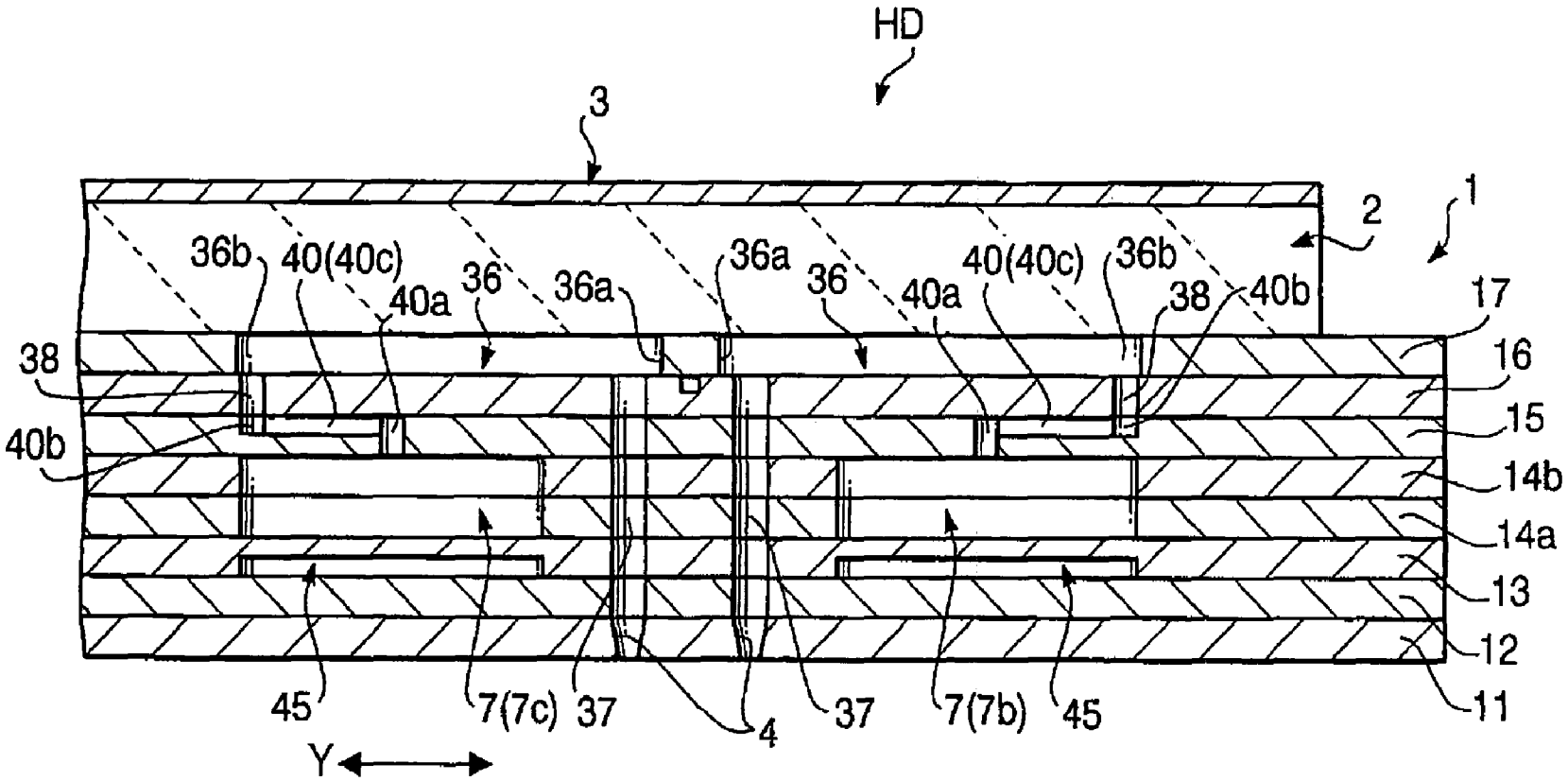
FIG. 3 is a cross sectional view along a line III-III of FIG. 1.

As shown in FIGS. 2 and 3, damper rooms 45 are formed on the bottom surface of the damper plate 13 as recessed portions so that the damper rooms are isolated from the common ink chambers 7. Outline shapes and positions of the damper rooms 45 coincide with those of the common ink chambers 7 when viewed along the laminating direction of the cavity unit 1.

Since the damper plate 13 is made of metal having elasticity, thin plate portions of the damper plate 13 formed at portions corresponding to the damper rooms 45 freely moves toward a common ink chamber side and toward a damper room side. That is, the thin plate portions can vibrates in the vertical direction on FIG. 3. By this structure, even if the pressure variation caused in the pressure chamber 36 is transmitted to the common ink chamber 7, the pressure variation is damped by elastic deformation (i.e. a damper effect) of the thin plate portion of the damper plate 13. Therefore, a crosstalk that a pressure variation caused in one pressure chamber 36 is transmitted to another pressure chamber 36 is prevented.

On the top surface of the third spacer plate 16, grooves 50 are formed to be elongated in the arranging direction (X-direction) of the pressure chamber row between adjacent pressure chamber rows. The groove 50 communicates with the outside of the cavity unit 1 via an opening so as to function as a fluid channel for an inspection. By detecting the outflow of air from the groove 50 at the opening or detecting the reduction of the pressure of ink on an ink supply opening side, leakage of ink at portions between the adjacent pressure chamber rows and leakage of ink from each pressure chamber 36 can be inspected.

As described above, by laminating the eight plates 11 through 17 with each other, the common ink chambers 7 are formed. Also, fluid channels each of which is elongated from the inlet hole 40*a* to the corresponding nozzle 4 via the through hole 38, the pressure chamber 36 and the through hole 37 are formed.

As shown in FIG. 1, at the one side portion of each of the base plate 17 and the second and third spacer plates 15 and 16, four ink supply openings are formed to penetrate each of the base plate 17 and the second and third spacer plates 15 and 16. The four ink supply openings are aligned along the shorter side direction (Y-direction) of each plate. In the following, the four ink supply openings are assigned numerical references of 47*a*, 47*b*, 47*c* and 47*d*, respectively. Positions of the four ink supply openings 47*a*, 47*b*, 47*c* and 47*d* on the base plate 17 substantially coincide with positions of the four ink supply openings 47*a*, 47*b*, 47*c* and 47*d* of the other plates 16 and 15.

Since five common ink chambers 7 are formed, the ink supply opening 47*a* is designed to communicate with two common ink chambers 7*a* and 7*a*. In this structure, black ink is supplied through the ink supply opening 47, considering the fact that the amount of black ink consumed per a unit time is the largest of all of color components of ink if the printing speed for monochrome printing is set to be higher than that of the color printing.

Yellow ink, magenta ink, and cyan ink are supplied to the ink supply openings 47*b*, 47*c* and 47*d*, respectively. The ink supply openings 47*b*, 47*c* and 47*d* communicate with the common ink chambers 7*b*, 7*c* and 7*d*, respectively (see FIG. 4).

Figure 4:
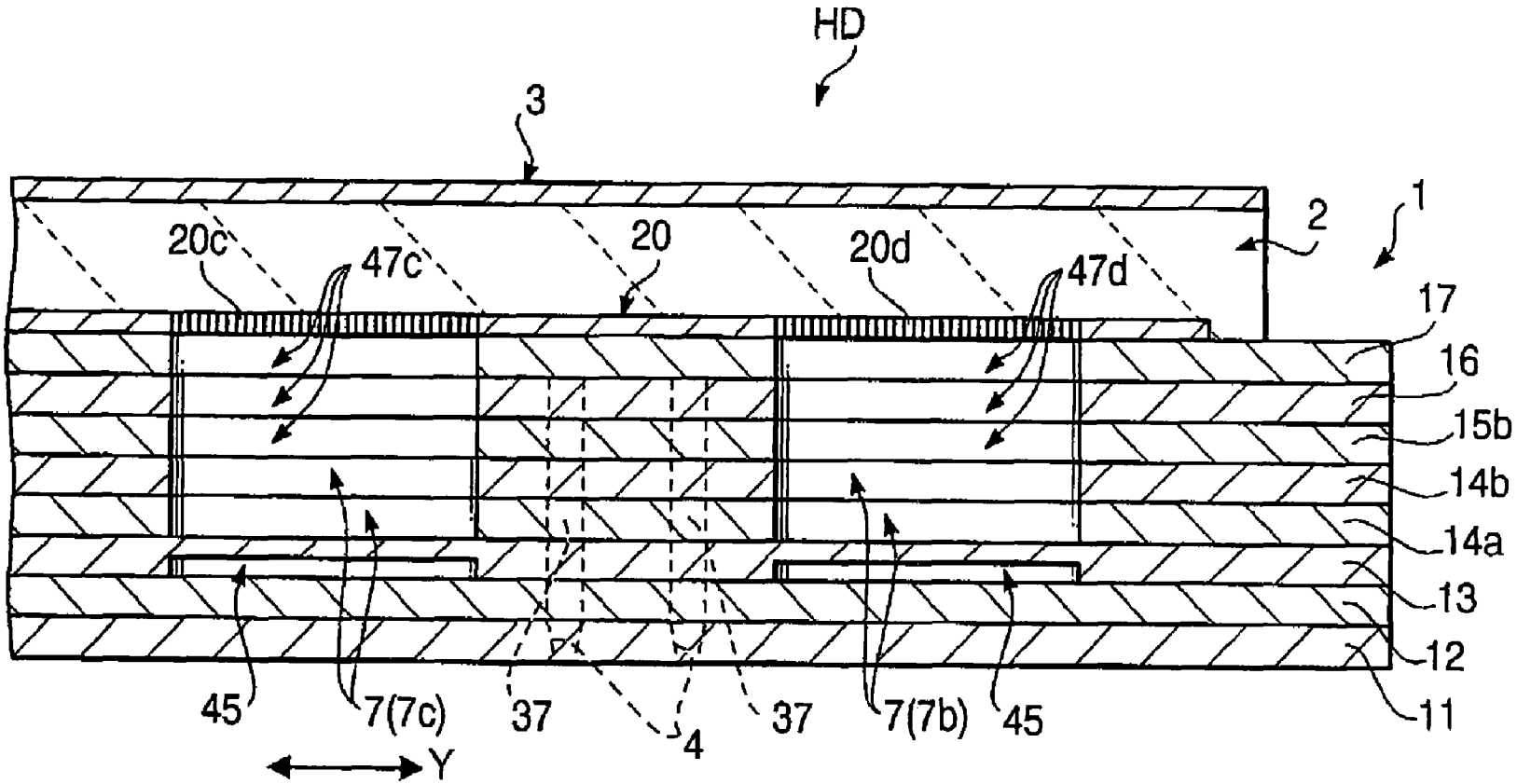
FIG. 4 is a cross sectional view along a line IV-IV of FIG. 1.

As shown in FIG. 4, each of the ink supply openings 47*b*, 47*c* and 47*d* is formed to substantially overlap with one end portion of the corresponding common ink chamber 7 when viewed along the laminated direction. Also, the ink supply opening 47*a* is formed to substantially overlap with one end portions of the common ink chambers 7*a* and 7*a* when viewed along the laminated direction.

Figure 6:
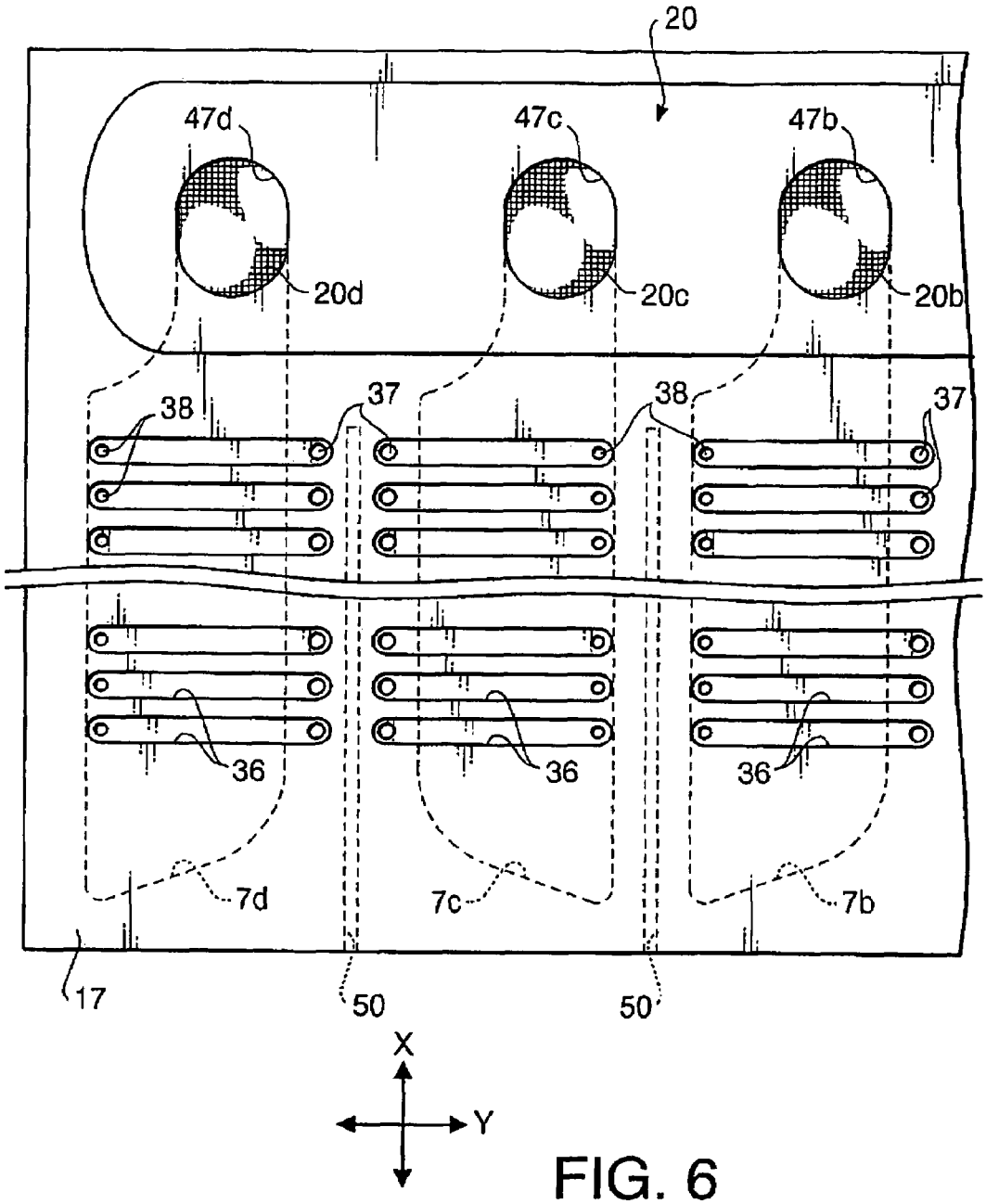
FIG. 6 is plan views of the inkjet head viewed from a base plate toward a bottom side of the inkjet head.

As shown in FIG. 6, outline shapes (and sizes) of the ink supply openings 47*b*, 47*c* and 47*d* are substantially equal to the one end portions (i.e. upstream end portions) of the common ink chambers 7*b*, 7*c* and 7*d*, respectively. Upstream end portions of the common ink chambers 7*a* and 7*a* are configured so that when viewed along the laminated direction, the total of sizes of the upstream end portions of the common ink chambers 7*a* and 7*a* is substantially equal to the ink supply opening 47*a* for black ink.

It should be noted that various types of processing such as etching, electrical discharge machining, plasma processing or laser processing can be used for making holes and recessed portions in the plates 12 through 17 including the ink supply openings 47, common ink chambers 7, through holes 37 and 38, channels 40, the damper room 45 and the grooves 50.

Figure 5:
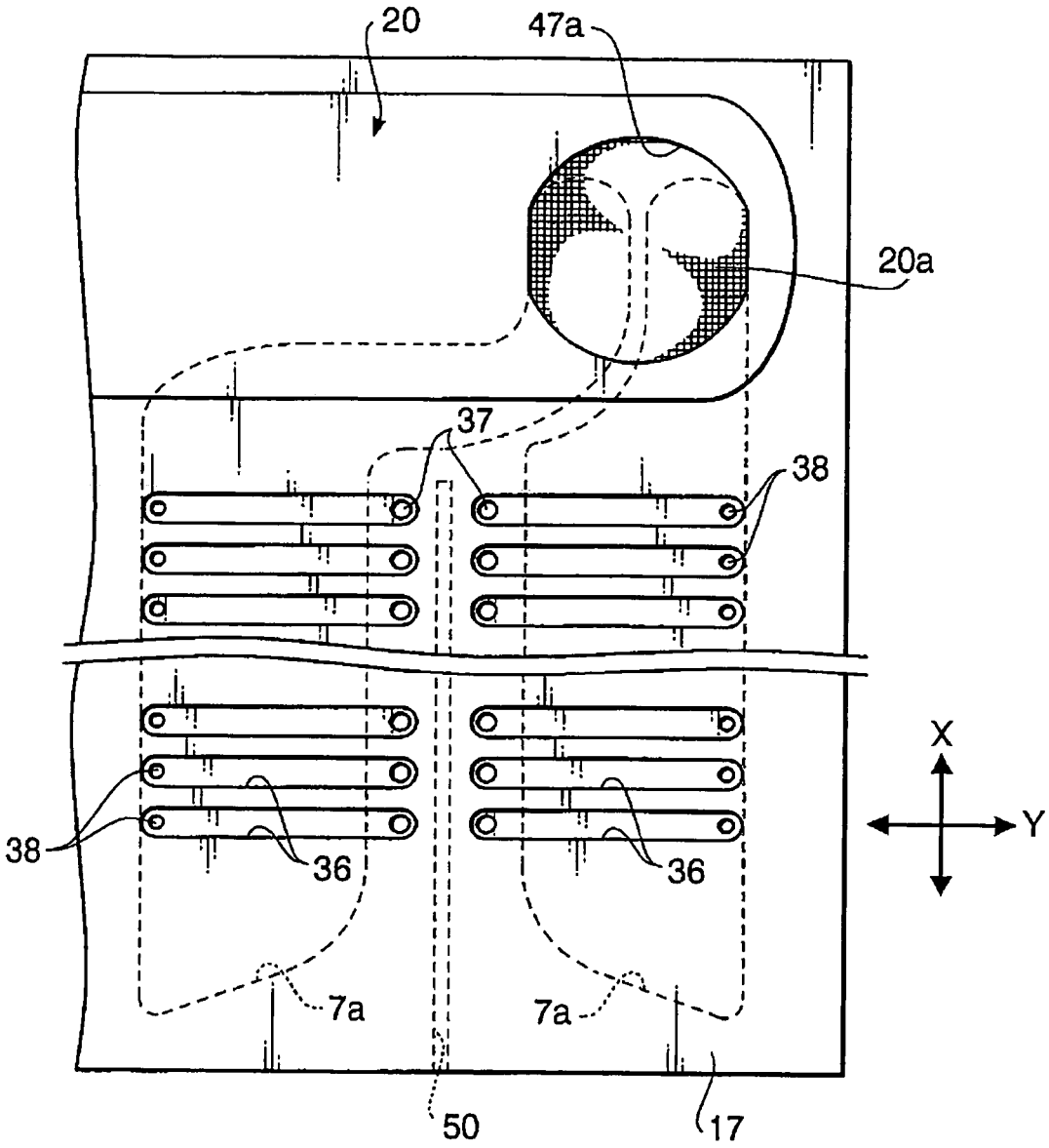
FIG. 5 is plan views of the inkjet head viewed from a base plate toward a bottom side of the inkjet head.

Next, a filter 20 according to the embodiment of the invention will be described in detail with reference to FIGS. 4 to 6. To the top surface of the base plate 17, the filter 20 is adhered, by use of an adhesive, at a portion in which a group of ink supply openings 47*a*, 47*b*, 47*c* and 47*d* is formed to cover the ink supply openings 47*a*, 47*b*, 47*c* and 47*d*. The filter 20 is made of resin such as a polyimide and is configured to be a thin sheet-type member having a rectangular shape when viewed as a plan view. It is noted that only one filter 20 is used in this embodiment.

The filter 20 is provided with four filtering portions 20*a*, 20*b*, 20*c* and 20*d*, at positions corresponding to positions of the ink supply openings 47*a*, 47*b*, 47*c* and 47*d*, respectively. Each of the filtering portions 20*a*, 20*b*, 20*c* and 20*d* eliminates dust (and debris, etc.) from ink passing therethrough. The filtering portions 20*a*, 20*b*, 20*c* and 20*d* have substantially the same outline shapes (and sizes) as those of the ink supply openings 47*a*, 47*b*, 47*c* and 47*d*, respectively, when viewed as a plan view. The filter 20 is located so that the filtering portions 20*a*, 20*b*, 20*c* and 20*d* substantially overlap with the ink supply openings 47*a*, 47*b*, 47*c* and 47*d*, respectively.

Each of the filtering portions 20*a*, 20*b*, 20*c* and 20*d* has an elliptical shape (having two straight line portions) elongated along the X-direction when viewed as a plan view. A portion of the filter 20 except for the filtering portions 20*a*, 20*b*, 20*c* and 20*d* is adhered to the top surface of the base plate 17.

In this embodiment, considering occurrence of a positional error in adhering work of the filter 20, the filter 20 is configured such that the ink supply openings 20*a*, 20*b*, 20*c* and 20*d* are slightly larger than the ink supply openings 47*a*, 47*b*, 47*c* and 47*d*, respectively, when viewed as a plan view. The filtering portion 20*a* for black ink has an outline shape larger than outline shapes of all of the other filtering portions 20*b*, 20*c* and 20*d* when viewed as a plan view.

Various types of processes such as plasma processing and laser processing can be used to form the filtering portions 20*a*, 20*b*, 20*c* and 20*d* in the filter 20. For example, each filtering portion may be formed by forming a number of minute holes penetrating a base material of the filter 20 in a direction of thickness of the base material. If the filter 20 is made of metal, the filtering portion may be formed by electroforming.

In the above mentioned structure, ink is supplied from an ink reservoir (not shown) to the corresponding common ink chamber 7 after dust is removed from the ink when passing through the filter 20. Then, as shown in FIG. 2, the ink in the common ink chamber 7 is supplied to the end portion 36*b* of the pressure chamber 36 via the channel 40 of the second spacer plate 15 and the through hole 38 of the third spacer plate 16. Then, the ink in the pressure chamber 36 is supplied to the corresponding nozzle 4 via the through holes 37 by the actuation of the piezoelectric actuator 2.

It is noted that the filter 20 has a size large enough to cover all of the ink supply openings 47*a*, 47*b*, 47*c* and 47*d*, and has filtering portions respectively corresponding to the ink supply openings 47*a*, 47*b*, 47*c* and 47*d*. Therefore, it is not necessary to increase the number of filters in accordance with the number of ink supply openings (47*a*, 47*b*, 47*c* and 47*d*).

In addition, by only adhering the filter 20 to the top surface of the base plate 17 at the portion of the ink supply openings 47*a*, 47*b*, 47*c* and 47*d*, the filtering function of removing duct (and debris, etc.) from the ink can be attained. Therefore, the deterioration of performance of the inkjet head HD due to foreign material (dust, debris, etc.) can be prevented.

As described above, the portion of the filter 20 surrounding the filtering portions 20*a*, 20*b*, 20*c* and 20*d* is used as a gluing part. Such a configuration enables the gluing part and the filtering portions 20*a*, 20*b*, 20*c* and 20*d* to be integrally formed on a single sheet-type member (i.e. the filter 20). Therefore, it becomes possible to secure an adequate size on the filter 20 for the gluing part even if the length of the filter 20 in a longitudinal direction (Y-direction) of the filter 20 is within the shorter side width of the base plate 17.

As described above, the filtering portion (20*a*, 20*b*, 20*c* and 20*d*) is formed to have an elliptical shape elongated along the longer side direction of the base plate 17 when viewed as a plan view. By this structure, it becomes possible to reduce the width of each filtering portion in the shorter side direction (Y-direction) of the base plate 17 without increasing fluid channel drag. Further, it becomes possible to reduce the length of the filter 20 in the Y-direction while securing an adequate size of each filtering portion (20*a*, 20*b*, 20*c* and 20*d*).

As described above the filtering portions 20*a*, 20*b*, 20*c* and 20*d*, the ink supply openings 47*a*, 47*b*, 47*c* and 47*d*, and the upstream end portions of the common ink chambers 7 have substantially the same sizes and shapes, respectively, when viewed along the laminating direction, and they substantially overlap with each other when viewed along the laminating direction. Therefore, a step portion causing retention in the ink flow is not formed in an inside wall of a fluid channel from the filtering portion to the common ink chamber 7. Consequently, stability of ejecting motion of the inkjet head HD is enhanced.

According to the embodiment of the invention, the filter 20 can be formed as compact as possible while attaining the adequate filtering function and securing an adequate size of the gluing part. Such a configuration avoids the necessity for increasing the size of the base plate 17 in the shorter side direction, and also avoids the necessity for increasing intervals of the ink supply openings 47. Accordingly, the inkjet head HD can be configured to be compact in size. Since only one filter 20 is used in the cavity unit 1, the amount of manufacturing processes is not increased for the filter 20.

As described above, the number of common ink chambers is five on the one hand, the number of ink supply openings (i.e. the number of nozzle rows and the number of pressure chamber rows) is four on the other hand. The ink supply opening 47*a* is formed to communicate with the two common ink chambers 7*a* and 7*a*. With this structure, it becomes possible to reduce the intervals of the ink supply openings 47 in the Y-direction in comparison with a case in which the number of ink supply openings is equal to the number of common ink chambers. Therefore, it becomes possible to decrease the length in the Y-direction of each of the base plate 17, second spacer plate 15 and third spacer plate 16 while securing adequate sizes of the ink supply openings 47*a*, 47*b*, 47*c* and 47*d* in a plan view.

In this embodiment, the two common ink chambers 7*a* and 7*a* are used in combination but are not united as a single chamber. Therefore, the rigidity of the cavity unit 1 is enhanced.

The area of the filtering portion 20*a* in a plan view is larger than that of the other filtering portions 20*b*, 20*c* and 20*d*. By such a structure, it is prevented that the supply of ink to the common ink chambers 7*a* and 7*a* decreases due to the structure of the filtering portion 20*a*. Also, in regard to the structure of the ink supply openings 47, it is not necessary to increase the length in the shorter side direction of each of the base plate 17, the space plates 15 and 16. By this structure, the inkjet head 1 can be configured to be compact in size while keeping the adequate filtering function.

The piezoelectric sheet 2 has a laminated structure of a plurality of piezoelectric sheets and a top sheet, each of which has a thickness of about 30 μm. A piezoelectric sheet situated at the undermost layer of the piezoelectric actuator 2 is provided with a plurality of slit-like electrodes on the top surface thereof, at positions corresponding to the positions of the pressure chambers 36 of the cavity unit 1. The slit-like electrodes in each electrode row are aligned along the X-direction. Each slit-like electrode is formed to be elongated in the Y-direction so that end portions of outward slit-like electrodes reach the peripheral portion of the undermost piezoelectric sheet.

If the layers of the piezoelectric actuator 2 are counted from the undermost layer, even-numbered layers is provided with common electrodes on their top surfaces, respectively. Each common electrode is used for the plurality of pressure chambers 36. The uppermost layer of the piezoelectric actuator 2 is provided with a plurality of electrodes 9 respectively corresponding to the slit-like electrodes of the undermost layer. The plurality of electrodes 9 include electrodes electrically connected to the slit-like electrodes of the undermost layer, respectively, and an electrode connected to the common electrode.

The piezoelectric actuator 2 may be configured to have a configuration different from the above mentioned configuration as indicated in, for example, U.S. Pat. No. 5,402,159, the disclosure of which is incorporated herein by reference.

The piezoelectric actuator 2 may be assembled as follows. Firstly, an adhesive sheet made from synthetic resin adhesive having a non-penetrative property for ink is attached to the entire region of the bottom surface (a surface facing the pressure chambers 36) of the electric actuator 2. Then, the piezoelectric actuator 2 is attached to the cavity unit 1 so that each of the slit-like electrodes of the undermost layer faces the corresponding one of the pressure chambers 36.

The flexible flat cable 3 is attached to the top surface of the piezoelectric actuator 2 by heating and pressurization so that electrical wiring patterns of the flexible flat cable 3 are electrically connected to the electrodes 9 of the top surface of the piezoelectric actuator 2.

In the above mentioned structure, if a voltage is applied between the common electrode and one of the slit-like electrodes, an active part between the common electrode and the one slit-like electrode is deformed by piezoelectric vertical effect in a laminated direction of the layers of the piezoelectric actuator 2.

The deformation decreases the volume of the corresponding pressure chamber 36. Therefore, if the piezoelectric sheet sandwiched between the common electrode and the one slit-like electrode has a polarizing direction equal to a direction of the electric field applied thereto, ink in the pressure chamber 36 is ejected from the nozzle 4 as a drop of ink.

Although the present invention has been described in considerable detail with reference to certain preferred embodiments thereof, other embodiments are possible.

For example, the base material of the filter 20 may be a thin plate-like member made of metal. In this case, various types of processing such as electroforming processing, plasma processing or laser processing can be used for making filtering portions in the base material.

In the above mentioned embodiment, the filtering portion is formed to have an elliptical form; however, various types of shapes including an oval shape, a rectangular shape and a polygonal shape may used to form the filtering portion in the base material of the filter.

Various types of ink such as gloss ink may be used by the inkjet head HD. In the above mentioned embodiment, the ink supply opening 47 is formed such that one or two common ink chambers communicate with the ink supply opening. However, the ink supply opening may be configured such that three or more common ink chambers communicate with the ink supply opening.

Various types of shapes including a circular shape, an ellipse, an elliptical shape, a rectangular shape and a polygonal shape may used to form the ink supply opening.

If the cavity unit 1 is designed so that of the shorter side of the cavity unit 1 has a length shorter than that of the above mentioned embodiment, the ink supply opening may be designed to have a width in the sorter side direction of the cavity unit 1 narrower than that of the above mentioned embodiment. The number of ink supply openings may be different from that of the above mentioned embodiment.

In view of the stability of a ink ejection property, it is preferable that the filtering portion, the ink supply opening and the upstream end portion of the common ink chamber have substantially the same shape and size as mentioned above so that they overlap with each other when viewed as a plan view. By this structure, a smooth ink flow can be secured without causing retention of air bubbles in the ink flow.

What is claimed is

1. An inkjet head, comprising:

a plurality of nozzle rows each of which has a plurality of nozzles arranged along a first direction;

a plurality of pressure chambers connected to the plurality of nozzles;

a plurality of common ink chambers respectively corresponding to the plurality of nozzle rows;

a plurality of fluid channels connecting the plurality of common ink chambers to the plurality nozzles via the plurality of pressure chambers;

a plurality of ink supply openings corresponding to the plurality of common ink chambers, the plurality of ink supply openings being arranged along a second direction different from the first direction so that each of the plurality of ink supply openings communicates with corresponding one of the plurality of common ink chambers; and a filter located to cover the plurality of ink supply openings, the filter including:

filtering portions that have functions of eliminating dust in ink flowing therethrough; and non-filtering portions which surround the filtering portions when viewed as a plan view, the filtering portions respectively corresponding to the plurality of ink supply openings, each of the filtering portions being configured such that a size of an outline thereof in the first direction is longer than a size of the outline in the second direction when viewed as a plan view.

2. The inkjet head according to claim 1, wherein the inkjet head has a rectangular shape; and the first direction is parallel with a longer side direction of the rectangular shape of the inkjet head, and the second direction is parallel with a shorter side direction of the rectangular shape of the inkjet head.

3. The inkjet head according to claim 1, wherein each of the filtering portions has an elliptical shape.

4. The inkjet head according to claim 1, wherein at least one ink supply opening of the plurality of ink supply openings communicates with two or more of the plurality of common ink chambers; and one of the filtering portions corresponding to the at least one ink supply opening has an outline shape larger than outline shapes of all of the other filtering portions.

5. The inkjet head according to claim 1, wherein each of the filtering portions is elongated along a direction in which each of the common ink chambers is elongated;

each of the plurality of ink supply openings has a shape substantially the same as that of corresponding one of the filtering portions; and each of the filtering portions communicates with an end portion of corresponding one of the plurality of common ink chambers via corresponding one of the plurality of ink supply openings.

6. The inkjet head according to claim 5, wherein each of the filtering portions substantially overlaps with the corresponding one of the plurality of ink supply openings and the end portion of the corresponding one of the plurality of common ink chambers when viewed as a plan view so that no step portion is formed in a fluid channel formed of the each of the filtering portions, the corresponding one of the plurality of ink supply openings and the end portion of the corresponding one of the plurality of common ink chambers.

7. The inkjet head according to claim 1, wherein the filter is formed to be a thin sheet-type member.

8. The inkjet head according to claim 1, wherein the inkjet head has a laminated structure of a plurality of layers; and the filter has a gluing part surrounding the filtering portions, the filter being adhered to an end portion of a layer through the gluing part, the layer being provided with the plurality of ink supply openings.

9. The inkjet head according to claim 1, wherein the plurality of common ink chambers include five common ink chambers;

the plurality of ink supply openings include four ink supply openings; and the filtering portions include four filtering portions.

* * * * *